United States Patent [19]

Plante

[11] 4,244,471

[45] Jan. 13, 1981

[54] PACKAGING SYSTEM

[75] Inventor: Robert F. Plante, St. Joseph, Mich.

[73] Assignee: Whirlpool Corporation, Benton Harbor, Mich.

[21] Appl. No.: 28,096

[22] Filed: Apr. 9, 1979

[51] Int. Cl.[3] ..... B65D 81/02

[52] U.S. Cl. ..... 206/586; 206/386; 206/523

[58] Field of Search ..... 206/597, 600, 586, 523, 206/524, 585, 587, 386

[56] References Cited

U.S. PATENT DOCUMENTS

| | | | |
|---|---|---|---|
| 2,319,966 | 5/1943 | Wood et al. | 206/587 |
| 2,728,479 | 12/1955 | Wheeler . | |
| 2,745,590 | 5/1959 | Herzor et al. . | |
| 2,910,221 | 10/1959 | Whiton . | |
| 3,030,728 | 4/1962 | Wesman . | |
| 3,049,260 | 8/1962 | Stone | 206/586 X |
| 3,401,814 | 9/1968 | Chiswell et al. . | |
| 3,429,095 | 2/1969 | Huson . | |
| 3,438,488 | 4/1969 | Rohde | 206/397 X |
| 3,477,604 | 11/1969 | Kridle . | |
| 3,522,688 | 8/1970 | Kalinoda et al. . | |
| 3,536,245 | 10/1970 | Palmer | 206/586 |
| 3,589,510 | 6/1971 | Begnaud | 206/497 |
| 3,590,549 | 7/1971 | Zelnick . | |
| 3,640,048 | 2/1972 | Zelnick et al. . | |
| 3,662,512 | 5/1972 | Zelnick . | |
| 3,667,598 | 6/1972 | Zelnick et al. . | |
| 3,675,765 | 7/1972 | Melsek . | |
| 3,734,389 | 5/1973 | Brown | 206/586 |
| 3,752,384 | 8/1973 | Siburn . | |
| 3,835,986 | 9/1974 | Le Beau . | |
| 3,870,152 | 3/1975 | Kaplan . | |
| 3,891,086 | 6/1975 | Isaacs . | |
| 3,944,070 | 3/1976 | Cardwell et al. | 206/497 X |
| 3,983,997 | 10/1976 | Warshaw | 206/497 X |
| 3,986,611 | 10/1976 | Dreher . | |
| 4,000,704 | 1/1977 | Griffin Jr. | 206/599 |
| 4,050,604 | 9/1977 | Flanders . | |

FOREIGN PATENT DOCUMENTS

| | | | |
|---|---|---|---|
| 2051026 | 4/1972 | Fed. Rep. of Germany | 206/597 |

*Primary Examiner*—Joseph Man-Fu Moy

*Attorney, Agent, or Firm*—Wegner, Stellman, McCord, Wood & Dalton

[57] ABSTRACT

A packaging system designed for home appliances, comprises a bottom cap, a top cap, and a plurality of corner angles extending vertically between the bottom cap and top cap and having leg portions facially abutting outer surfaces of the appliance at vertical corners thereof. The corner angles are vertically corrugated and, are formed as synthetic resin extrusions. Each leg of the corner angles have a plurality of planar suface portions facially engaging the appliance surface. The legs of the corner angles define outer planar surfaces engaging complementary planar surfaces of the end caps for providing a stable assembly of the corner angles and end caps. The corner angles have a length greater than the height of the appliance so as to space the top cap above the top surface of the appliance. The packaged assemblies have sufficient rigidity to permit stacking one on top of the other. The packages assembly includes a transparent outer wrapper for retaining the end caps and corner angles on assembled relationship in the packaged assembly. The wrapper may be adhesively bonded to the periphery of the end caps and may be stretched during the application of the wrapper to the assembly so as to provide a biaxial stressing and orientation of the synthetic resin material for improved strength characteristics in the packaged assembly. The end caps may be provided with interlocking structure for preventing horizontal translation of the packages assemblies relative to each other in the stacked relationship.

30 Claims, 10 Drawing Figures

FIG. 1
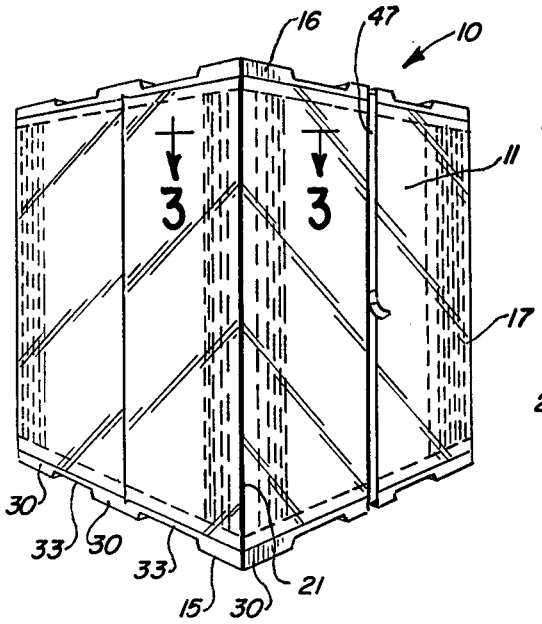
FIG. 2
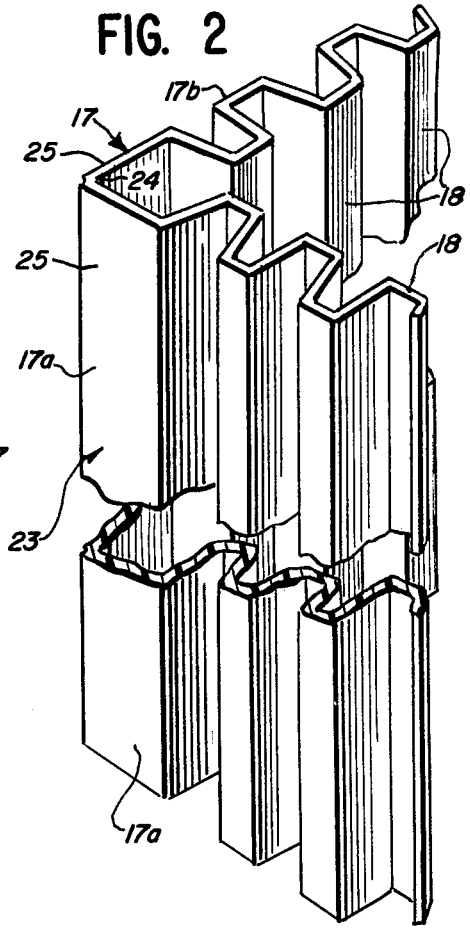
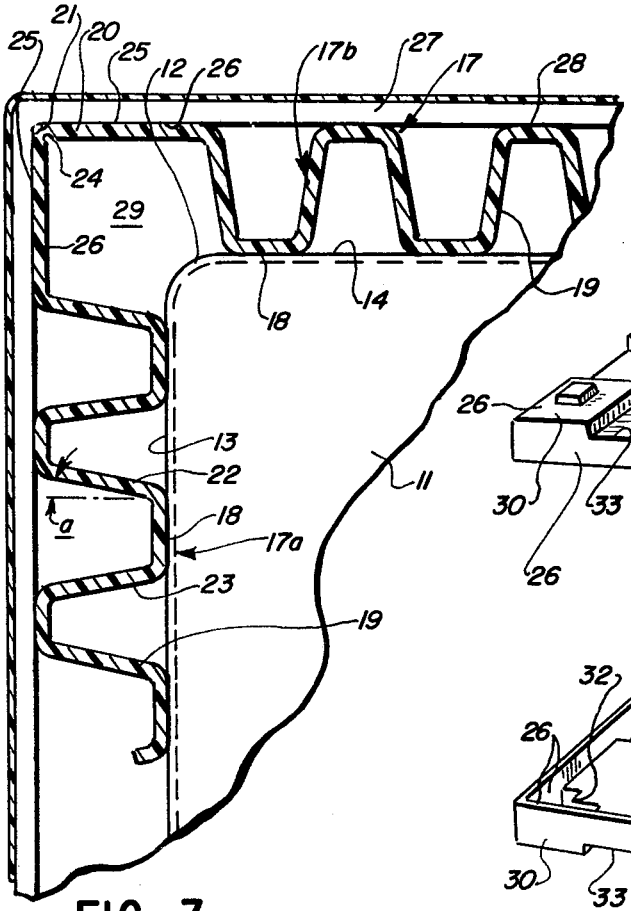
FIG. 3
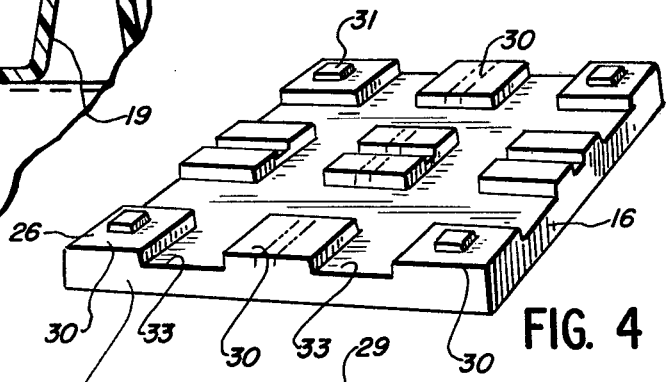
FIG. 4
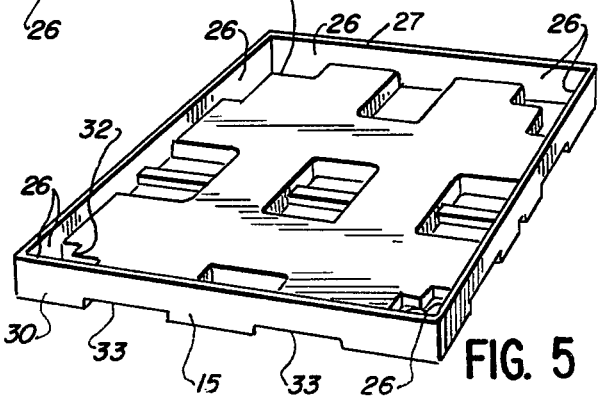
FIG. 5

FIG. 6
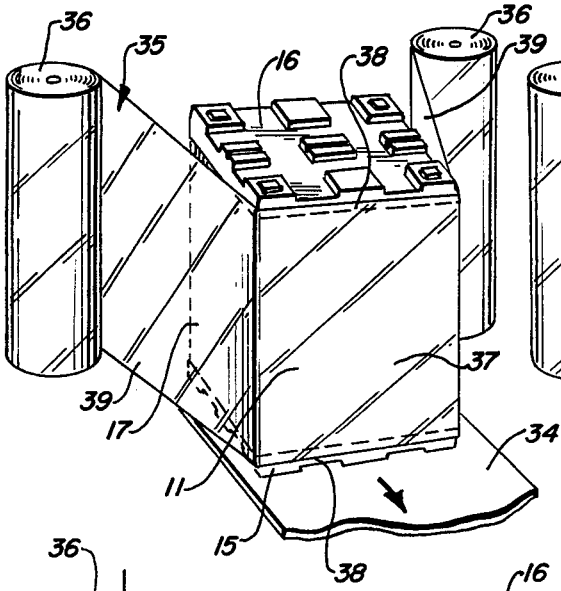
FIG. 7
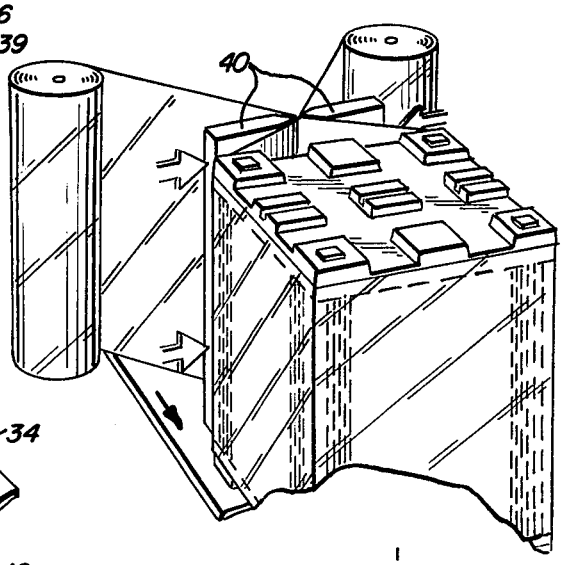
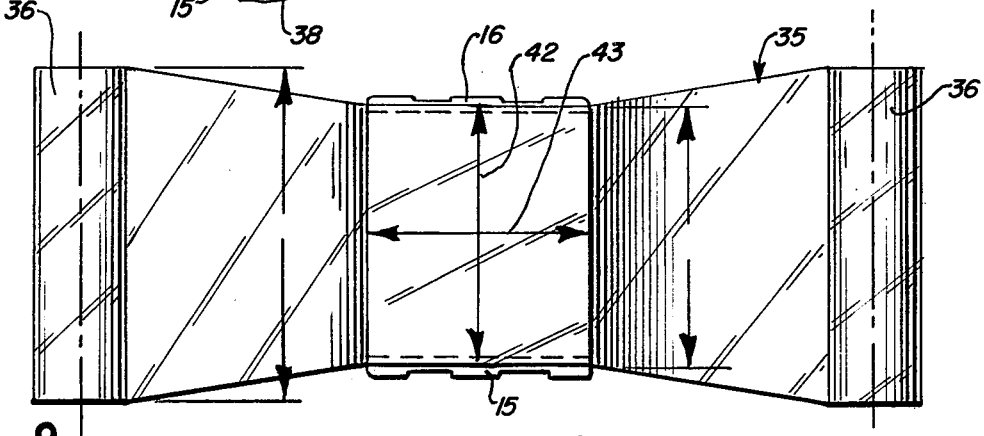
FIG. 8
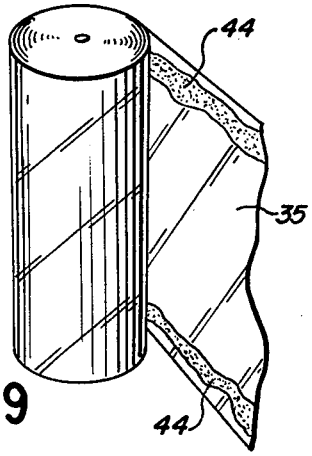
FIG. 9
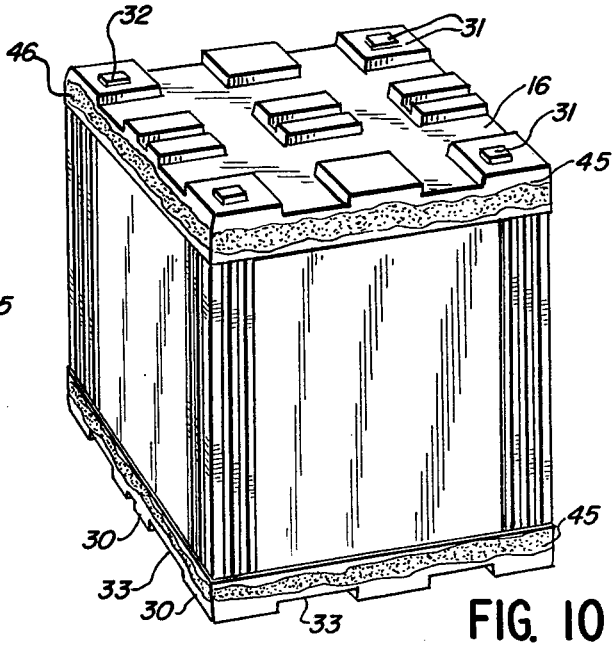
FIG. 10

PACKAGING SYSTEM

BACKGROUND OF THE INVENTION

1. Field of the Invention

This invention relates to packaging systems, and in particular to packaging systems for packaging relatively large objects, such as home appliances, and permitting a substantial number of packaged assemblies to be stacked.

2. Description of the Prior Art

One prior art example of packaging of appliances, such as household refrigerators and the like, is illustrated in U.S. Pat. No. 3,891,086, of Jack L. Isaacs. As shown therein, the appliance is packaged in a structure including top and base elements, posts extending between the top and base elements, and a shrink-wrapped sheet. A band member forcibly encircles the top and base elements extending into notches of the posts. The top cap element is provided with a pocket for lifting and transporting the package. The posts are generally "V" configuration, having divergent substantially planar legs.

Donald J. LeBeau shows, in U.S. Pat. No. 3,835,986, a composite package for enclosing an appliance, such as a water heater, utilizing rectangular end members having depressions for receiving the ends of the water heater. A rectangular intermediate member is provided with a circular opening through which the water heater passes. Elongated reinforcing members are positioned to engage locating notches at the corners of the intermediate member and are received within corner depressions formed in the end members. A biaxially oriented, heat-shrunk synthetic transparent film is wrapped about the assembly to hold the members in assembled relationship and protect the water heater while permitting visual inspection thereof.

Robert D. Flanders shows a disassembleable, reusable container in his U.S. Pat. No. 4,050,604. The container includes a floor, bracing support, sidewall and lid members interlockingly joined to each other. The bracing support members include a pair of slots for receiving a lower portion of the floor member.

Packaging systems somewhat similar to the systems of the Isaacs, LeBeau and Flanders patents discussed above have been utilized by others. Illustratively, one such packaging system utilizing top and bottom end caps and corner posts has been found to be in public use in New Zealand.

It is further known in the packaging art to provide cushioning material which may be formed to have corrugations and the like. Illustratively, Alton H. Stone shows, in U.S. Pat. No. 3,049,260, cushioning material for use in the packaging field which is formed of an expanded synthetic resin, such as polystyrene or polyurethane.

In U.S. Pat. No. 3,752,384, Gene E. Siburn shows a resilient packaging spacer formed of flexible joined triangular or wedge-shaped elements and equipped with a flexible insert means for attaching the spacer through a slit in the carton, such as a paperboard container. The spacer is adapted for spacing water heaters and the like in a container.

The use of transparent outer wrapping sheets to articles carried on a pallet is illustrated in U.S. Pat. No. 3,986,611 of Donald H. Dreher. As disclosed therein, at least two substantially superimposed tensioned wraps of flexible cling film web are wrapped about the loaded pallet. The film web has a specified cling energy. A brush or semiflexible member is utilized to impart a planishing pressure wipe to the film as it contacts and adheres to the objects on the pallet.

It has further been known to utilize a plastic bag which is swung over an appliance, such as a warm air furnace, disposed within protective corrugated corner posts, with the bag being shrink-fitted to the enclosed furnace in a suitable oven.

It is further known to utilize stretch wrapping devices for film wrapping of pallet loads. One such device is that identified as the Arenco MIPAC M-1 automatic stretch wrapping system for pallet loads.

Other U.S. Letters Patent showing packaging systems utilizing corner posts or similar structures for protecting the corners of objects being packaged include U.S. Pat. Nos. 2,728,479 of D. B. Wheeler; 3,030,728 of V. A. Wesman; 3,315,867 of P. R. Seltman; 3,346,105 of W. T. Nye et al; 3,870,152 of Paul N. Kaplan; 3,990,576 of James J. Heaney. Each of these patents, however, shows a corner post structure substantially different from the corner post structure of the present invention and none shows or suggests such a corner post structure having a corrugated wall section providing flat surfaces bearing against the appliance for improved support thereof in the packaged assembly.

A number of additional U.S. Letters Patent disclose packaging systems utilizing end caps, interconnecting cornerposts and film wraps about the packaged assembly. Such additional prior art patents include U.S. Pat. Nos. 2,745,590 of H. A. Herzog et al; 2,910,221 of A. L. Whiton; 3,401,814 of A. P. Chiswell et al; 3,429,095 of G. Huson; 3,477,604 of C. E. Kridle; 3,522,688 of K. Kaliwoda et al; 3,590,549 of Seymour Zelnick; 3,640,048 of Seymour Zelnick et al; 3,662,512 of Seymour Zelnick; 3,667,598 of Seymour Zelnick et al; and 3,675,765 of N. J. Melsek. While the above enumerated additional packaging systems patents utilize film wraps, such as shrink film wraps, none of the indicated patents shows a packaging system utilizing molded end caps, corrugated extruded corner angles having flat surface portions bearing against the sides of the appliance being packaged, and film wrappers adhesively secured to the periphery of the end caps.

SUMMARY OF THE INVENTION

The present invention comprehends an improved packaging system for packaging an object, such as a home appliance, having a perimetral array of vertical corners defined by planar intersecting outer surfaces. The packaging system may comprise a bottom cap and a top cap with vertically extending corrugated corner angles having ends engaging the caps. The corrugations of the angles define a plurality of planar inner surfaces at each side of the object corners for facially engaging and supporting the object in a damage-proof manner.

Means are provided for maintaining the assembly of the caps, corner angles and packaged object as a packaged assembly with the object fixedly retained within the packaging structure.

The corner angles may further define outer planar surfaces facially engaging complementary planar surfaces on the end caps for further improved secured packaging of the object.

The corner angles may be provided with a formed notch for facilitating folding of the corner angles to extend angularly complementarily to the corners of the object.

The end caps may define recesses for receiving the ends of the corner angles.

The corner angles may comprise extrusions formed of synthetic resin material and the end caps may comprise solid phase formed or injection molded members of synthetic resin material. The synthetic resin material may be reused in molded part form or comprise recycleable material for economy and energy conservation.

The corner angles may have a length greater than the height of the appliance or object being packaged so as to dispose the top cap spaced to some degree above the object.

The means for maintaining the packaged assembly may comprise a wrapper extending in an unstretched state about the assembled object, caps and corner angles. The wrapper may comprise a transparent sheet formed of a synthetic resin or the like.

The wrapper may be wrapped only horizontally about the assembled object end caps and corner angles. The wrapper may be adhesively secured to the periphery of the end caps.

The wrapper may be wrapped under tension so as to provide a stretched condition thereof, affording a biaxial stressing and orientation of the synthetic resin material in the packaged system.

In the illustrated embodiment, the end caps and corner angles are formed of polypropylene. A strap of suitable material, such as polypropylene or the like, may be wrapped about the wrapped assembly for further securing the assembly.

In the illustrated embodiment, the adhesive means comprises contact cement which may be applied to the periphery of the end caps and to the edges of the wrapper sheet so as to provide a facilitated wrapping operation wherein the assembly is automatically secured as a result of the wrapping.

The midportion of the sheets being wrapped about the assembly may be firstly urged against a front portion of the end cap peripheries with portions of the sheet extending oppositely from the midportion then being wrapped rearwardly about the sides of the assembly and brought together at the rear of the assembly. The sheets may be joined as by heat-sealing at the rear to complete the wrapping operation.

The packaging system and method of packaging of the present invention, as discussed above, is extremely simple and economical while yet providing a highly efficient, energy conserving, improved packaging of objects, such as appliances and the like.

BRIEF DESCRIPTION OF THE DRAWING

Other features and advantages of the invention will be apparent from the following description taken in connection with the accompanying drawing wherein:

FIG. 1 is a perspective view of a packaging system embodying the invention;

FIG. 2 is a fragmentary perspective view of a corner angle utilized in the packaging system;

FIG. 3 is a fragmentary enlarged horizontal section taken substantially along the line 3—3 of FIG. 1;

FIG. 4 is a top perspective view of the top end cap;

FIG. 5 is a top perspective view of the bottom end cap;

FIG. 6 is a perspective view illustrating a first step in the wrapping of the assembly;

FIG. 7 is a fragmentary perspective view illustrating the method of securing the wrapper about the assembly;

FIG. 8 is a schematic elevation illustrating the stretching of the wrapper sheet material during the wrapping operation;

FIG. 9 is a perspective view illustrating the provision of contact adhesive on the edges of the wrapper sheet; and FIG. 10 is a perspective view of the wrapped package omitting the securing strap of the package of FIG. 1.

DESCRIPTION OF THE PREFERRED EMBODIMENT

In the exemplary embodiment of the invention as disclosed in the drawing, a packaging system generally designated 10 is provided for packaging an object, such as an appliance 11 having a perimetral array of vertical corners, such as corners 12 illustrated in FIG. 3. As shown, the corners are defined by planar intersecting outer surfaces 13 and 14. In the illustrated embodiment, the appliance is generally a parallelepiped whereby the corner surfaces 13 and 14 extend at substantially right angles. As will be obvious to those skilled in the art, other angular arrangements of the object corners may be accommodated in the packaging system. As will further be obvious to those skilled in the art, the surfaces 13 and 14 may comprise nonplanar surfaces, such as arcuate surfaces, within the scope of the invention.

The packaging system includes a bottom end cap 15, a top end cap 16, and a plurality of upright posts 17 comprising vertically corrugated members. In the illustrated embodiment, the posts comprise corner angles which, as shown in FIGS. 2 and 3, define legs **17*a* and 17*b* each of which further defines a series of column sections and a series of inner surfaces 18 facially engaging the outer surfaces 13 and 14 of the object 11. In the illustrated embodiment, surfaces 18 are planar surfaces so as to facially engage the planar corner surfaces 13 and 14 of the appliance and provide an improved, large area, marproof support of the appliance along the vertical extent of the surfaces 13 and 14. In the illustrated embodiment, three planar surfaces 18 engage each side of the appliance object 11** at a corner of the appliance. Experience with the present invention indicates that three or more planar surfaces on each leg of the corner angles or posts positively protect the appliance during handling, storage and shipment.

The corner angles may be formed of extruded synthetic resins, such as polypropylene or the like. Thus, the corrugations 19 may be integrally extruded in the corner angles. The corner angles may include a midportion 20 which may be folded at a centerline 21 to extend the legs **17*a* and 17*b* of the corner angles suitably angularly to each other to dispose the corrugation inner surfaces 18 in facial engagement with the appliance surfaces 13 and 14. In the illustrated embodiment, the midportion 20 is provided with a notch 24 for facilitating the folding of the corner angles along the centerline 21**.

As further shown in FIG. 3, midportion 20 effectively defines a pair of angularly extending outer surfaces 25 facially engaging complementary inwardly facing surfaces 26 of a wall portion 27 of the end cap 15. The upper end of the corner angle similarly engages corresponding inwardly facing corner surfaces 26 of the top cap 16.

As still further shown in FIG. 3, each of the corrugations 19 of the legs **17*a* and 17*b* further defines column sections having leg portions 22 and 23 each of which extends at an approximate angle a of 13° with respect to a line normal to one of said planar surfaces 18. The corrugations 19 also include outer surfaces 28 facially engaging the end cap surfaces 26 so as to cooperate with the engagement of surfaces 18 with surfaces 13 and 14 in providing a secured retention of the object 11** within the assembly of the end caps and corner posts.

Thus, the corner posts, or angles, 17 each provide six column sections three on each side of each corner to withstand squeeze pressures in a compression mode. The 13° angle of the column section permits the post side to creep or "walk" longitudinally when "humping" forces in box car loads exceed squeeze loads encountered in storing the appliances. The "walking" absorbs shock energy instead of transferring it to the packaged product. When the shock force is removed the spring capability of the post shape with its columns and angular leg portions permits the post to spring back to its original shape.

As shown in FIG. 5, the surfaces 26 may be defined in part by suitable wells 29 formed in the end caps, such as end cap 15. As further shown in FIGS. 4 and 5, the end caps may comprise injection molded members which, similarly to the corner angle posts 17, may be formed of a recycleable synthetic resin, such as polypropylene.

As further shown in FIGS. 4 and 5, the end caps may be provided with a plurality of stiffening bosses 30 and the top end cap may be provided with projecting lugs 31 which may be received in complementary recesses 32 in the bottom end cap 15 (FIG. 5) for preventing lateral translation between successively stacked packaged assemblies, thereby permitting safely stacking a substantial number of such packaged assemblies, such as five or more, where the home appliances comprise relatively heavy objects, such as automatic washers for washing clothes, clothes driers, furnaces, dehumidifiers, trash compactors, refrigerators, vertical freezers and the like.

As further shown in FIGS. 1, 4, 5 and 10, the bosses 30 of bottom end cap 15 cooperatively define a plurality of channels 33 for receiving the forks of conventional fork lift trucks, fork lift dollies or other handling carts such as handling personnel may choose to use to permit handling of the packaged appliances.

As indicated briefly above, means are provided for maintaining the end caps, corner angles, and appliance as an assembly for retaining the appliance fixedly within the packaging system. As shown in FIGS. 6–10, the assembly of the object 11, end caps 15 and 16, and corner posts 17 may be placed on a suitable conveyor 34 and passed into a web 35 of wrapper material which may comprise a transparent synthetic resin such as polyethylene, approximately 0.003 inches thick or thicker. Polypropylene may also be used. The clear wrapper film being transparent, also functions to provide visibility for the observance of any damage so that it may be corrected before delivery of the product to the customer. The film may be a single thickness or laminate make-up as required for additional strength, puncture or tear resistance or antivermin penetration.

The wrapper material may be provided in suitable rolls 36 and effectively defines a midportion 37 engaged by the front portion 38 of the end caps 15 and 16. The sheet portions 39 extending oppositely from midportion 37 are wrapped automatically about the sides of the assembly as the assembly is moved forwardly on conveyor 34, as shown in FIG. 6. The wrapping is preferably effected under tension so as to reduce the height of the web as shown in FIG. 8 as a result of the stretching of the web during the wrapping operation. Such stretching causes the web to become biaxially stressed and oriented so as to provide an improved strong retention of the assembly in the final package.

When the partially wrapped assembly passes forwardly of roll 36, the sheet portions 39 may be brought together by suitable movable heat sealing bars 40 and heat sealed along a vertical seam so as to complete the wrapping operation. As shown in FIG. 8 by the arrows 42 and 43, the biaxial orientation of the film 35 extends at right angles so as to provide desirable strength both vertically and horizontally in the final packaged assembly.

The wrapper sheet 35 is preferably secured to the end caps during the wrapping operation. As shown in FIGS. 9 and 10, the sheet 35 may be provided at its top and bottom edges with a suitable adhesive, such as contact cement 44. The periphery 45 of the end caps may be provided with suitable similar contact cement 46 so that when the sheet 35 is wrapped about the assembly, the sheet is firmly bonded to the end caps in the stretched condition thereof by the engagement of cement 44 with cement 46 during the wrapping operation.

As shown in FIG. 1, the wrapped assembly may be further secured by means of a strap 47, if desired. The strap may be formed of any suitable material and, illustratively, may comprise a polypropylene strap. Thus, each of the strap, end caps, and upright posts may be recycled as reusable components or for their resin content for energy conservation.

The molded bottom cap 15 may be solid phase formed or molded online adjacent the assembly line area so as to be placeable on the conveyor for receiving the appliance and facilitating further handling thereof. The posts 17 may similarly be molded online and automatically assembled to the bottom caps and brought into engagement with the side surfaces of the object, such as the appliance, being packaged. Thus all of the components of the package may practically be made right in the manufacturing plant, at the product packaging area.

The invention comprehends that the top cap may also be molded online and installed in place automatically upon the placement of the posts 17 in association with the bottom cap and appliance, as discussed above. Thus, the partial assembly of the package may be automatically effected in a novel and simple manner. Further, the thusly partially assembled package may be continued on the conveyor to the wrapping apparatus discussed above for effecting an automatic wrapping operation without further handling of the partial assembly.

In the illustrated embodiment of the packaging for an automatic washer, the total weight of the synthetic resin material forming the end caps and corner angle posts was approximately 7 lbs.

As will be obvious to those skilled in the art, the invention may be utilized with objects to be packaged having a wide range of different configurations. The invention comprehends providing recycleable support and end cap members which provide mar-resistant engagement with the object while yet assuring a positive, fixed packaging of the object in the assembly. Thus, the posts extending between the end caps are arranged to have a large area facial engagement with the outer surface of the object being packaged and are preferably formed of a material which is preselected to have minimum marring characteristics relative to the surface of the object being packaged. The use of recycleable materials for the end caps and post materials provides substantial energy conservation while yet assuring a strong packaging system permitting facilitated warehousing and storage of the objects by permitting a large number of the packaged objects to be stored one on top of the other as a result of the strong characteristics of the packaging system and without concern for the hazard of degradation from rain or humidity damage to the package.

As indicated above, the length of the posts 17 may be preselected to space the top cap above the top of the object being packaged so as to cause downwardly directed forces on the package as from overlying stacked packages to be passed downwardly through the posts and not onto the appliance. Thus, the packaging system is advantageously adapted for packaging appliances having control consoles and the like on the top portions thereof.

A further advantage of the disclosed packaging system is the moistureproof packaging of the appliance effected by the bonding of the wrapper sheet to the molded end caps.

It will be appreciated that the present invention, through the use of planar surfaces between appliances and angled subsections with springy support columns between the planar surfaces, provides means to structurally support the weight of five or more high packaged appliances, structurally contain and absorb the lateral lifting forces of lift trucks, and provides a spring section to absorb severe shipment impact forces permitting the impacted shape to spring back to its original shape for packaged product shape integrity.

The foregoing disclosure of specific embodiments is illustrative of the broad inventive concepts comprehended by the invention.

I claim:

1. A packaging system for packaging an object having a perimetral array of vertical corners defined by planar intersecting outer surfaces, said packaging system comprising:

a bottom cap having upwardly directed corner retaining portions having angularly extending portions corresponding to the angular intersection of said object outer surfaces, said retaining portions being defined by spaced inner and outer vertical walls;

a top cap having downwardly directed corner retaining portions having angularly extending portions corresponding to the angular intersection of said object outer surfaces, said top cap retaining portions being defined by spaced inner and outer vertical walls;

corner angles having bottom ends engaging said bottom cap retaining portions and top ends engaging said top cap retaining portions, said corner angles defining a pair of flat portions defining an effectively inextensible corner portion and a pair of thin wall corrugated legs extending extensibly outwardly from the flat corner portions and having free ends, the corrugations of said angle legs defining a plurality of planar inner surfaces for facially engaging the cap inner walls and each side of the object corners and a plurality of planar outer surfaces facially engaging the cap whereby said corrugated legs may expand away from and contract toward said corner portion as a result of shock forces applied to and removed from the outer surfaces; and means for maintaining said bottom cap, top cap and corner angles as an assembly for packaging said object fixedly therein.

2. The packaging system of claim 1 wherein said top and bottom cap retaining portions outer walls define intersecting inwardly facing outer planar surfaces and said corner portion of the corner angles defines complementary intersecting outwardly facing outer planar surfaces facially engaging said cap retaining portions outer planar surfaces.

3. The packaging system of claim 1 wherein said top and bottom cap retaining portions outer walls define intersecting inwardly facing outer planar surfaces and said corner portion of the corner angles defines complementary intersecting outwardly facing outer planar surfaces facially engaging said cap retaining portions outer planar surfaces, said corner portion being further defined by a notch between said outer planar surfaces providing for facilitated folding of said corner angles at said notch to cause said corner angles outer planar surfaces to extend accurately complementarily to said cap retaining portions outer planar surfaces.

4. The packaging system of claim 1 wherein said top and bottom cap retaining portions outer walls define angularly related inwardly facing outer planar surfaces and said corner angle corrugations define a plurality of planar outer surfaces facially engaging said cap retaining portions outer planar surface.

5. The packaging system of claim 1 wherein said top cap defines upwardly projecting lugs and said bottom cap defines downwardly opening recesses for receiving the upwardly projecting lugs of a subjacent top cap, whereby a plurality of objects packaged one each in said packaging system may be interlocked in vertically stacked association.

6. The packaging system of claim 1 wherein said corner angles comprise extrusions formed of synthetic resin material.

7. The packaging system of claim 1 wherein each of said corner angle legs each have three or more said planar surfaces for facially engaging the sides of said packaged object at a corner portion thereof.

8. The packaging system of claim 1 wherein the corrugations of said corner angle legs form columns having leg portions each of which extends at an approximate angle of 13° with respect to a line normal to one of said planar surfaces.

9. The packaging system of claim 1 wherein said caps comprise solid phase formable or injection molded members formed of synthetic resin material.

10. The packaging system of claim 1 wherein said corner angles have a length preselected to be greater than the height of the object to be packaged to provide a clearance space above the packaged object when the top cap is fitted onto the upper ends of the corner angles with the object resting on the bottom cap.

11. The packaging system of claim 1 wherein said object has a parallelepiped configuration and said corner angles define right angularly extending portions embracing one each the vertical right angle corners of the object.

12. The packaging system of claim 1 wherein said retaining portion of the caps comprises wells formed therein.

13. A packaging system for packaging an object having a perimetral array of vertical corners defined by planar intersecting outer surfaces, said packaging system comprising:

bottom cap having upwardly directed corner retaining portions having angularly extending portions corresponding to the angular intersection of said object outer surfaces;

a top cap having downwardly directed corner retaining portions having angularly extending portions corresponding to the angular intersection of said object outer surfaces;

corner angles having bottom ends engaging said bottom cap retaining portions and top ends engaging said top cap retaining portions, said corner angles defining a pair of flat portions defining an effectively inextensible corner portion and a pair of thin wall corrugated legs extending extensibly outwardly from the flat corner portions and having free ends, the corrugations of said angle legs defining a plurality of planar inner surfaces for facially engaging the cap inner walls and each side of the object corners and a plurality of planar outer surfaces facially engaging the cap outer walls, whereby said corrugated legs may expand away from and contract toward said corner portion as a result of shock forces applied to and removed from the outer surfaces; and a wrapper extending about the assembled object, caps and corner angles for maintaining the same as a packaged assembly with said object fixedly retained therein.

14. The packaging system of claim 13 wherein said wrapper comprises a transparent sheet.

15. The packaging system of claim 13 wherein said wrapper comprises a transparent sheet formed of synthetic resin.

16. The packaging system of claim 13 wherein said wrapper is wrapped only horizontally about said assembled object, caps and angles.

17. The packaging system of claim 13 wherein said wrapper is wrapped only horizontally about said assembled object, caps and angles and is adhesively secured to the periphery of said caps.

18. The packaging system of claim 13 wherein said wrapper comprises a sheet wrapped under tension about the assembled object, caps and angles.

19. The packaging system of claim 13 further including at least one strap wrapped about the wrapped assembly.

20. The packaging system of claim 13 wherein said caps are formed of recycleable synthetic resin.

21. The packaging system of claim 13 wherein said caps are formed of polypropylene.

22. The packaging system of claim 13 wherein said corner angles are formed of recycleable synthetic resin.

23. A packaging system for packaging an object having a perimetral array of vertical corners defined by planar intersecting outer surfaces, said packaging system comprising:

a bottom cap;

a top cap;

a plurality of corner angles each having bottom ends retained by said bottom cap and top ends retained by said top cap, each of said corner angles defining a pair of flat portions defining an effectively inextensible corner portion and a pair of thin wall corrugated legs extending extensibly outwardly from the flat corner portions and having free ends, the corrugations of said angle legs defining a plurality of inner surfaces for facially engaging each side of the object corner embraced by the corner angle and said flat portion of the corner angles respectively extending substantially parallel to said side, whereby said corrugated legs may expand away from and contract toward said corner portions as a result of inwardly acting shock forces applied to and removed from the legs; and means for maintaining said bottom cap top cap and corner angles as an assembly for packaging said object fixedly therein.

24. The packaging system of claim 13 wherein said caps are provided with transverse channels defining spaces for receiving the forks of a conventional fork lift truck or a lift dolly.

25. The packaging system of claim 13 further including at least one strap formed of polypropylene wrapped about the wrapped assembly.

26. The packaging system of claim 13 wherein all surfaces engageable with said object are defined by polypropylene material.

27. The packaging system of claim 13 wherein said wrapper and caps are provided with contact cement, said wrapper being secured to said caps by said contact cement.

28. A packaging system for packaging an object having a perimetral array of vertical corners defined by planar intersecting outer surfaces, said packaging system comprising:

a bottom cap;

a top cap;

a plurality of corner angles each having bottom ends retained by said bottom cap and top ends retained by said top cap, each of said corner angles defining a pair of flat portions defining an effectively inextensible corner portion and a pair of thin wall corrugated legs extending extensibly outwardly from the flat corner portions and having free ends, the corrugations of said angle legs defining a plurality of inner surfaces for facially engaging each side of the object corner embraced by the corner angle whereby said corrugated legs may expand away from and contract toward said corner portion as a result of inwardly acting shock forces applied to and removed from the legs; and means for maintaining said bottom cap, top cap and corner angles as an assembly for packaging said object fixedly therein.

29. The packaging system of claim 28 wherein each leg includes at least three column sections defining the corrugations thereof.

30. The packaging system of claim 28 wherein each leg includes at least three column sections defining the corrugations thereof and the free end of each leg defines a portion of a column section extending only partially the spacing between said planar inner and outer surfaces.

* * * * *